US005970572A

United States Patent [19]

Thomas

[11] Patent Number: 5,970,572

[45] Date of Patent: Oct. 26, 1999

[54] BATTERY-OPERATED HAND VACUUM CLEANER WITH LIQUID SPRAY

[75] Inventor: Paul-Gerhard Thomas, Neunkirchen, Germany

[73] Assignee: Robert Thomas Metall- und Elektrowerke, Neunkirchen, Germany

[21] Appl. No.: 08/988,318

[22] Filed: Dec. 10, 1997

[30] Foreign Application Priority Data

Dec. 11, 1996 [DE] Germany ..... 196 51 477

[51] Int. Cl.[6] ..... A47L 9/32

[52] U.S. Cl. ..... 15/320; 15/344; 15/401

[58] Field of Search ..... 15/344, 320, 321, 15/322, 401

[56] References Cited

U.S. PATENT DOCUMENTS

| | | | |
|---|---|---|---|
| 4,776,058 | 10/1988 | Gorner | 15/320 |
| 4,788,738 | 12/1988 | Monson et al. | 15/320 |
| 5,025,529 | 6/1991 | Hult et al. | 15/344 |
| 5,392,490 | 2/1995 | Monson | 15/344 |
| 5,507,068 | 4/1996 | Fan et al. | 15/344 |
| 5,590,439 | 1/1997 | Alazet | 15/344 |
| 5,599,401 | 2/1997 | Brosky et al. | 15/320 |
| 5,819,364 | 10/1998 | Sham | 15/344 |

FOREIGN PATENT DOCUMENTS

| | | | |
|---|---|---|---|
| 586762 | 3/1994 | European Pat. Off. | 15/344 |

*Primary Examiner*—Gary K. Graham
*Attorney, Agent, or Firm*—Friedrich Kueffner

[57] ABSTRACT

A battery-operated hand vacuum cleaner includes a drive part which has a housing, wherein a handle is integrally formed onto the housing and the housing contains an electric motor for a blower, and an intake part with an air inlet, wherein the intake part is separable from the drive part. The drive part contains a tank for containing a liquid, the intake part is provided with a spray nozzle for the liquid, and separable means connecting the tank and the spray nozzle are provided for discharging the liquid.

19 Claims, 3 Drawing Sheets

BATTERY-OPERATED HAND VACUUM CLEANER WITH LIQUID SPRAY

BACKGROUND OF THE INVENTION

1. Field of the Invention

The present invention relates to a battery-operated hand vacuum cleaner with a drive part which has a housing, wherein a handle is integrally formed onto the housing and the housing contains an electric motor for a blower, and with an intake part with an air inlet, wherein the intake part is separable from the drive part.

2. Description of the Related Art

Hand vacuum cleaners of the above-described type are used for quickly and efficiently cleaning surfaces of all types. EP 0 008 117 B2 discloses a self-contained dry vacuum cleaner which includes a drive part and an intake part which can be separated from each other. A handle is formed onto the housing of the drive part. An electric motor operated by batteries for a blower and air outlet openings are provided in the housing.

The intake part has a hollow housing which has an air inlet and an open end which can be releasably connected to the housing by means of snap-type closures, and a dust bag unit arranged between the air inlet and the blower. Such a hand vacuum cleaner merely serves for vacuuming granular and dust-like materials from tables and floors.

EP 0 357 189 discloses a self-contained wet/dry vacuum cleaner in which the intake part has a baffle plate for separating liquids. However, cleaning agents must be applied separately.

EP 0 586 762 discloses a line-powered steam vacuum cleaner in which the steam generator with its steam nozzles are arranged in the drive part. The steam vacuum cleaner merely serves for vacuuming a liquid.

U.S. Pat. No. 5,507,068 relates to a washing vacuum cleaner which merely has a single-piece housing to which a fresh water tank and a waste water tank can be coupled. This washing vacuum cleaner is also only capable of collecting water or dirty water because it merely has very narrow slot openings. Solid and dry materials cannot be removed with this apparatus.

SUMMARY OF THE INVENTION

Therefore, it is the primary object of the present invention to provide a battery-operated hand vacuum cleaner of the above-described type which is capable of vacuuming wet material as well as dry material and which additional is capable of applying a spray of cleaning agent.

In accordance with the present invention, the drive part contains a tank for containing a liquid, the intake part is provided with a spray nozzle for the liquid, and separable means connecting the tank and the spray nozzle are provided for discharging the liquid.

As a result of the configuration according to the present invention, for cleaning surfaces by means of the battery-operated hand vacuum cleaner, it is possible in addition to the normal vacuuming effect to apply a cleaning agent, so that the cleaning effect of the hand vacuum cleaner is increased. The liquid can be discharged in specific quantities if the means for discharging the liquid include a pump for conveying the liquid, wherein the pump may be an electrically operated pump or a manually operated pump.

A releasable supply of the cleaning agent from the tank to the spray nozzle is achieved if the means for discharging the liquid include a hose line with coupling elements located between the drive part and the intake part.

It has been found advantageous to provide the means for discharging the liquid and/or the coupling with means which prevent continued dripping of the liquid and which prevent emptying of the tank when the drive part and the intake part are uncoupled.

A problem-free accommodation of the liquid supply is achieved if the housing of the intake part has a duct for receiving the hose line, wherein the housing is provided with a cover for closing the duct, and if the cover is provided with a means for receiving the part of the coupling element arranged in the intake housing and with an opening for exchangeably receiving the spray nozzle provided in the front portion of the intake housing and integrated in a nozzle holder.

The liquid tank can be arranged during the operation of the hand vacuum cleaner above the pump if the tank is arranged in the portion of the drive part facing away from the air inlet, for example, in the handle, and if this part is provided with a filler neck.

A simple operation of the vacuum cleaner is achieved by providing a combined switching element for actuating the motor and the pump, or by providing separate switching elements for actuating the motor and the pump, wherein, however, both switching elements are arranged in the immediate vicinity of the handle.

In accordance with another feature of the present invention, the spray nozzle may have a spray opening for a fan-like, point-like or conical application of a cleaning liquid.

In accordance with an advantageous feature, a suction nozzle can be inserted into the air inlet, wherein the suction nozzle is constructed in such a way that it is capable of taking in water even in the case of a slight negative pressure, so that only a small quantity of residual moisture remains on the surface to be cleaned.

In accordance with the invention, the suction nozzle may have an opening surrounded by geometric configurations which facilitate the intake of water, for example, rubber lips.

When the tank is filled and cleaning liquid is discharged, the filling level of the tank can be determined by providing a filling level indicator for the liquid, for example, a viewing window.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
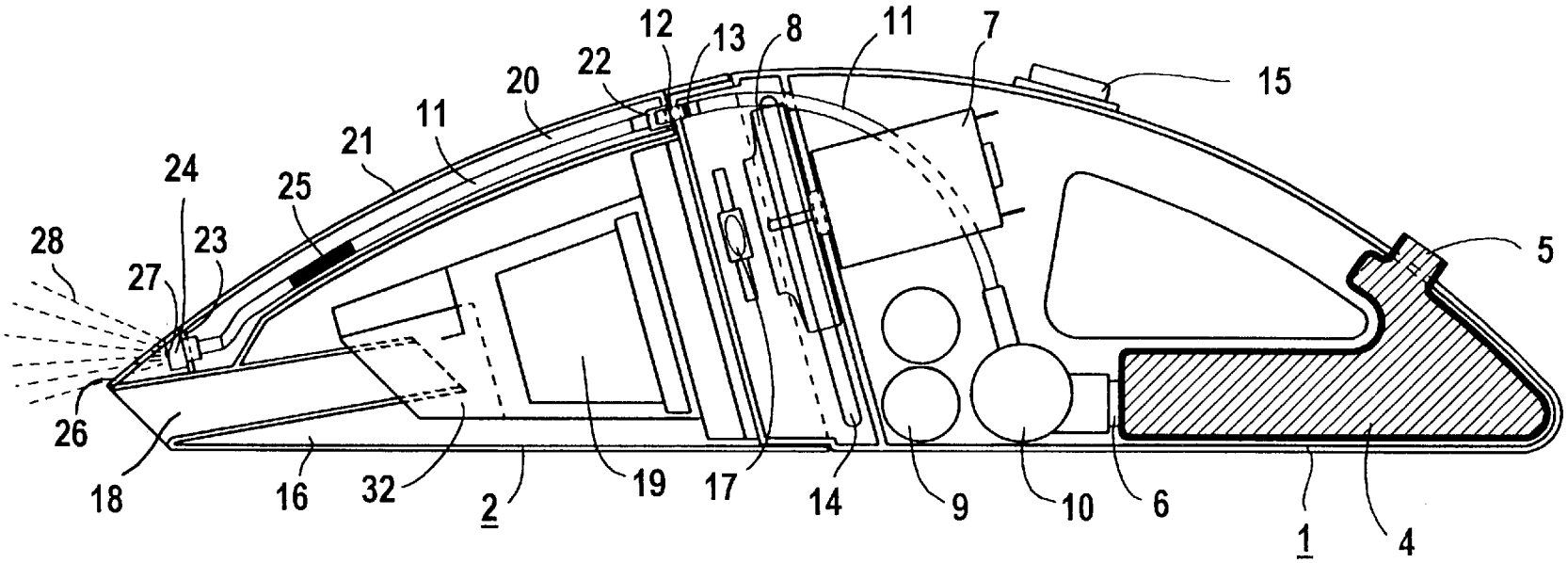
FIG. 1 is a sectional view of a battery-operated hand vacuum cleaner according to the present invention.
Figure 2:
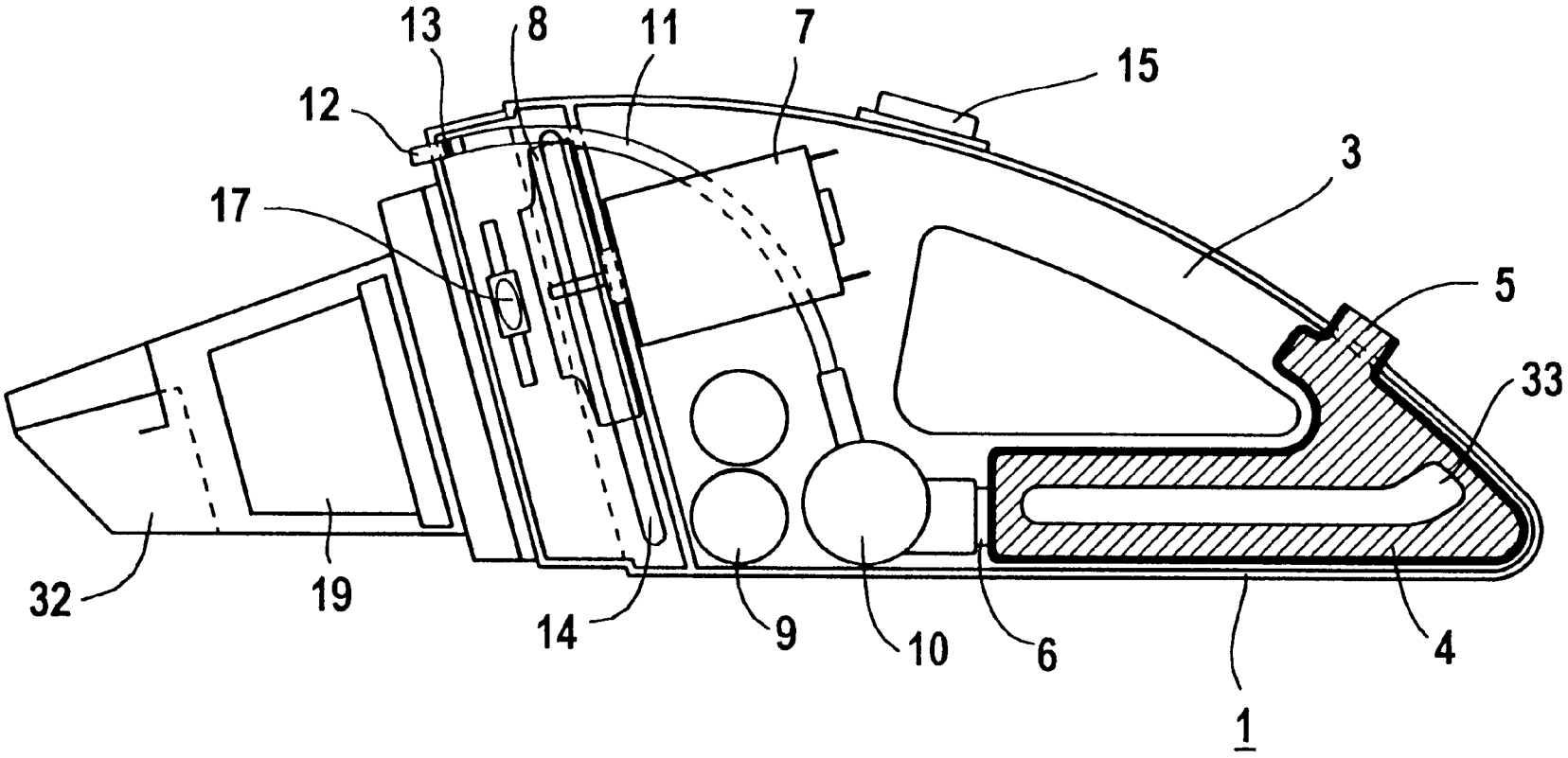
FIG. 2 is sectional view of the drive part of the vacuum cleaner of FIG. 1.
Figure 3:
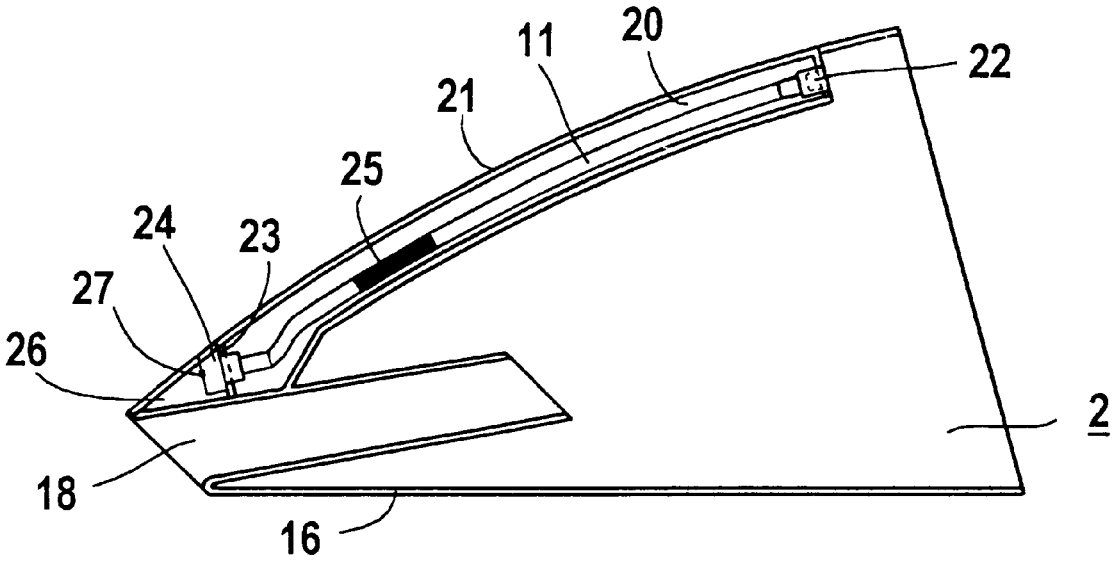
FIG. 3 is sectional view of the intake part of the vacuum cleaner of FIG. 1.

FIG. 1 of the drawing shows the electric hand vacuum cleaner according to the present invention for cleaning surfaces of any type. The vacuum cleaner includes a drive part 1 and an intake part 2 which can be separated from each other, as can be seen in FIGS. 2 and 3. The drive part 1 has a housing and a handle 3 integrally formed onto the housing. The handle 3 includes a tank 4 for a liquid, for example, a cleaning agent. The tank 4 can be filled through a filler neck 5. For recognizing the filling level, the tank 4 may have a filling level indicator for the liquid, for example, a viewing window 33; the viewing window 33 may additionally be provided with markings, not shown.

An opening 6 for removing the cleaning agent is formed onto the tank 4. The housing of the drive part 1 contains an electric motor 7 for a blower 8 and batteries 9. A pump 10 is provided for removing the cleaning agent through the opening 6, wherein the pump 10 may be electrically operated by the batteries 9 or the pump 10 may be manually operated.

A hose line 11 is attached to the outlet of the pump 10, wherein the other end of the line 11 is provided with a coupling element 12. A valve 13 is provided in the coupling element 12, wherein the valve 13 prevents the tank 4 from emptying when being uncoupled.

The drive part 1 includes two air outlet openings 14 arranged upstream of the blower 8. A combined switching element 15 arranged in the area of the handle 3 serves for alternatingly or jointly actuating the motor 7 and the pump 10. Instead of providing a combined switching element 15, it is also possible to use two separate electric switches.

The intake part 2 is composed of a hollow housing 16 which can be releasably connected to the drive part 1 by means of two snap-type closures 17. The housing 16 has an inlet 18 and an open end which can be pushed over the drive part 1 for fastening the intake part 2. A filter element 19 is arranged between the air inlet 18 and the blower 8, and a water separator 32 is arranged in front of the filter element 19. This water separator 32 acts in the known manner and prevents moisture, for example, cleaning agent liquid applied onto the floor, from penetrating into the drive part 1.

The hollow housing 16 of the intake part 2 has a duct 20 for receiving the hose line 11, wherein the duct 20 can be closed by a cover 21. The cover 21 includes means for receiving the part of the coupling element 22 located in the hollow housing 16 and a nozzle holder 23 with integrated spray nozzle 24. A valve 25 is arranged in the hose line 11 between the coupling element 22 and the spray nozzle 24, wherein the valve 25 only has to be designed for low pressure and serves to prevent continued dripping of the cleaning liquid.

For replacing the spray nozzle 24, the hand vacuum cleaner is provided with an opening 26 located in the front part. The spray nozzle 24 has a spray nozzle 27 for discharging the cleaning liquid 28 in a fan-shaped manner, point-like manner or conical manner. In spite of an only slight excess pressure, the spray nozzle 24 ensures a satisfactory discharge of the cleaning liquid 28.

For operating the battery-operated hand vacuum cleaner according to the present invention, the tank 4 is filled through the opening 5 with a cleaning liquid. The intake part 2 is attached to the drive part 1 by means of the snap-type closures 17. The two parts of the hose line 11 are connected to each other by the coupling elements 12 and 22. For vacuuming, the switching element 15 is actuated. When the cleaning agent is to be discharged, the switching element 15 is actuated accordingly, so that pump 10 is driven and the cleaning liquid 28 is conducted through the hose line 11 and sprayed through the spray opening 27 of the spray nozzle 24. When using a manual pump instead of the electrical pump 10, a pump lever must be actuated for extracting the spray liquid. When spraying is interrupted, the valve 25 ensures that the cleaning agent cannot continue to flow. The hand vacuum cleaner according to the present invention vacuums dry dirt and liquids as well as the cleaning agent.

For emptying the filter element 19, the drive part 1 and the intake part 2 can be separated from each other by opening the snap-type closures 17 after the vacuum cleaner has been switched off. Simultaneously, the coupling elements 12 and 22 connecting the hose line 11 are separated, wherein the valve 13 prevents cleaning agent liquid contained in the tank 4 from flowing out.

Figure 4:
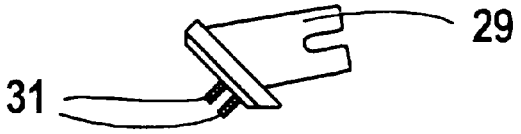
FIGS. 4 and 5 are a side view and a front view, respectively, of a suction nozzle according to the present invention for the hand vacuum cleaner of FIG. 1.

FIG. 4 of the drawing shows a special suction nozzle 29 according to the present invention which, if required, can be inserted into the air inlet 18 of the intake part 2.

Figure 5:
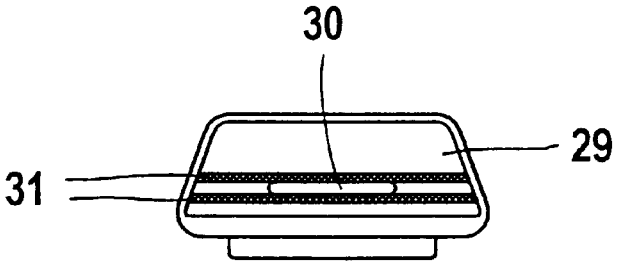

FIG. 5 shows a top view of the suction area of the suction nozzle 29 which has a small opening 30 surrounded by two rubber lips 31. This special suction nozzle 29 for cleaning textiles and hard smooth surfaces of all types, is capable of taking in water in spite of the low negative pressure, so that only a small residual amount of moisture remains on the surface.

An essential feature of the battery-operated hand vacuum cleaner according to the present invention is that fact that the hand vacuum cleaner is capable of applying cleaning liquid onto the surfaces to be vacuumed, wherein, in spite of only a low excess pressure, the spray nozzle produces a sufficient discharge of the cleaning agent, wherein a valve for low pressure prevents liquid from continuing to flow out, wherein a coupling is provided in the hand vacuum cleaner for the line for discharging the spray liquid, and wherein the hand vacuum cleaner is capable of taking in water in spite of the low excess pressure and/or the liquid tank is arranged during operation above the pump.

While specific embodiments of the invention have been shown and described in detail to illustrate the inventive principles, it will be understood that the invention may be embodied otherwise without departing from such principles.

I claim:

1. A battery-operated hand vacuum cleaner comprising a drive part with a housing and a handle integrally formed on the housing, a tank for receiving a liquid and an electric motor for a blower mounted in the housing, an intake part separably attached to the drive part, the intake part having an air inlet and a spray nozzle for the liquid, further comprising separable means connecting the tank and the spray nozzle for discharging the liquid, wherein the means for discharging the liquid comprise a hose line with coupling elements located between the drive part and the intake part.

2. The battery-operated hand vacuum cleaner according to claim 1, wherein the means for discharging the liquid comprise a pump for conveying the liquid.

3. The battery-operated hand vacuum cleaner according to claim 2, wherein the pump is an electrically operated pump.

4. The battery-operated hand vacuum cleaner according to claim 2, wherein the pump is a manually operated pump.

5. The battery-operated hand vacuum cleaner according to claim 1, wherein the means for discharging the liquid comprise means for preventing continued flow of the liquid.

6. The battery-operated hand vacuum cleaner according to claim 1, wherein the coupling elements comprise means for preventing emptying of the tank when the coupling elements are uncoupled.

7. The battery-operated hand vacuum cleaner according to claim 1, wherein the intake part comprises a housing defining a duct for receiving the hose line, and a cover for closing the duct, the cover comprising means for receiving one of the coupling elements arranged in the housing of the intake part and an opening for exchangeably receiving a spray nozzle arranged in a front part of the housing of the intake part and integrated in a nozzle holder.

8. The battery-operated hand vacuum cleaner according to claim 7, wherein the spray nozzle comprises a spray opening for applying the liquid in a fan-shaped manner.

9. The battery-operated hand vacuum cleaner according to claim 7, wherein the spray nozzle comprises a spray opening for applying the liquid in a point-like manner.

10. The battery-operated hand vacuum cleaner according to claim 7, wherein the spray nozzle comprises a spray opening for applying the liquid in a conical manner.

11. The battery-operated hand vacuum cleaner according to claim 1, wherein the tank is arranged in a portion of the drive part facing away from the air inlet, and wherein the tank is provided with a filler neck.

12. The battery-operated hand vacuum cleaner according to claim 1, wherein the tank is arranged in the handle.

13. The battery-operated hand vacuum cleaner according to claim 1, comprising a combined switching element for actuating the motor and the pump.

14. The battery-operated hand vacuum cleaner according to claim 1, comprising two switching elements for actuating the motor and for actuating the pump.

15. The battery-operated hand vacuum cleaner according to claim 1, comprising a switching element for actuating the motor and a mechanical actuating element for actuating the pump.

16. The battery-operated hand vacuum cleaner according to claim 1, comprising a suction nozzle inserted in the air inlet, the suction nozzle being configured to be capable of taking in water in spite of a low negative pressure, so that only a small amount of residual moisture remains on a surface to be cleaned.

17. The battery-operated hand vacuum cleaner according to claim 16, wherein the suction nozzle comprises an opening surrounded by rubber lips.

18. The battery-operated hand vacuum cleaner according to claim 1, wherein the tank comprises a filler level indicator for the liquid.

19. The battery-operated hand vacuum cleaner according to claim 18, wherein the filler level indicator comprises a viewing window.

* * * * *